US009879411B2

(12) United States Patent
Willers

(10) Patent No.: US 9,879,411 B2
(45) Date of Patent: Jan. 30, 2018

(54) TOILET ATTACHMENT COMPRISING A SHOWERING DEVICE

(71) Applicant: CARSTEN WILLERS CONSULTING GMBH, Ahaus (DE)

(72) Inventor: Carsten Willers, Duisburg (DE)

(73) Assignee: Carsten Willers Consulting GmbH, Dulsburg (DE)

( * ) Notice: Subject to any disclaimer, the term of this patent is extended or adjusted under 35 U.S.C. 154(b) by 0 days.

(21) Appl. No.: 14/655,763

(22) PCT Filed: Dec. 23, 2013

(86) PCT No.: PCT/EP2013/003913
§ 371 (c)(1),
(2) Date: Jun. 26, 2015

(87) PCT Pub. No.: WO2014/102006
PCT Pub. Date: Jul. 3, 2014

(65) Prior Publication Data

US 2015/0354190 A1 Dec. 10, 2015

(30) Foreign Application Priority Data

Dec. 28, 2012 (DE) ..... 10 2012 025 222

(51) Int. Cl.
*A47K 3/022* (2006.01)
*E03D 9/08* (2006.01)
*E03C 1/10* (2006.01)

(52) U.S. Cl.
CPC ..... *E03D 9/08* (2013.01); *E03C 1/102* (2013.01); *A47K 3/022* (2013.01)

(58) Field of Classification Search
CPC ..... E03D 9/08
USPC ..... 4/443–448
See application file for complete search history.

(56) References Cited

U.S. PATENT DOCUMENTS

| | | | |
|---|---|---|---|
| 3,455,324 | A | 7/1969 | Bieri et al. |
| 4,062,071 | A | 12/1977 | Blanquet |
| 5,003,645 | A | 4/1991 | Alonso |
| 5,452,483 | A | 9/1995 | Dizon |
| 6,192,527 | B1 | 2/2001 | Paul |
| 7,805,778 | B2 | 10/2010 | Liao |
| 8,296,872 | B2 | 10/2012 | Yao |
| 2004/0068785 | A1 | 4/2004 | Tomita |
| 2008/0016608 | A1 | 1/2008 | Lee |

FOREIGN PATENT DOCUMENTS

| | | | |
|---|---|---|---|
| DE | 19 94 14 893 | U1 | 11/1994 |
| DE | 20 2006 013 209 | U1 | 12/2006 |
| FR | 2 320 076 | A1 | 3/1977 |
| GB | 2 269 401 | A | 2/1994 |

OTHER PUBLICATIONS

International Search Report of International Application No. PCT/EP2013/003913 dated Mar. 11, 2014, 4 pages.
International Preliminary Report on Patentability of International Application No. PCT/EP2013/003913 dated Jun. 30, 2015, 8 pages.

*Primary Examiner* — Lori Baker
(74) *Attorney, Agent, or Firm* — Fay Sharpe LLP

(57) ABSTRACT

A water closet (WC) attachment includes a shower device and a water safety device which is connected by a conduit to the shower device. A channel is provided for discharging leakage from the water safety device. The shower device, the water safety device and the channel can be arranged on a base plate.

18 Claims, 3 Drawing Sheets

1
2
3
4
5
6
7
8
9
10
11
12
13
14
15
16
u
v
w
o
k

TOILET ATTACHMENT COMPRISING A SHOWERING DEVICE

BACKGROUND

The invention relates to a toilet attachment with a shower device and a water safety device, which is connected by a conduit to the showering device.

Water closets (WCs) with a shower device are also known as "shower-WCs". Commercially known shower-WCs have an integrated shower function for the anal and/or genital region of the user. For this purpose, a nozzle is arranged at the end of the shower device, through which the water discharges in the direction towards the area to be cleaned. The nozzle is generally extendible, either electromechanically or under water pressure. In the latter case, the water pressure is used for supplying the nozzle.

The shower device is controlled by means of a valve, by means of which the water supply is opened and closed. The actuation can be effected, for instance, manually, that is to say by turning the valve, whereby with electromechanical control a pulse is triggered, which effects opening or closing of the valve. The flow volume can additionally frequently be regulated.

Shower-WCs with an integral bidet are sophisticated WCs, which, depending on their configuration, have further functions, such as a drying function, a heating function of the WC seat and the like. Such shower-WCs have basically proved to be satisfactory. However, their complexity makes them very expensive. A move has therefore been made to offering shower devices as a retrofit component for conventional WCs as an alternative to shower-WCs with an integral shower device. It is here that the WC attachment in accordance with the invention finds application.

A WC attachment is disclosed in DE 20 2006 013 209 U1, which may be retrofitted as an additional module to a conventional WC. The WC attachment has a shower device and a water safety device, which are mounted on a base plate and are connected together by means of a hose-like conduit. The water safety device is a free outlet with an injector. A water jet is sprayed via a free space into a receptacle, which is of funnel-like construction. As a result of the free space, the water cannot run back to the injector. Contamination of the water is thereby impossible.

The leaking water runs directly from the water safety device into the WC bowl. The water safety device engages in a recess formed in the base plate, which is arranged above the WC bowl.

The known WC attachment permits economical retrofitting of conventional WCs. Merely a separate water connection is necessary for the bidet function.

It has, however, been found that the construction of the known WC attachment is not optimal. In particular, the engagement of the water safety device through the base plate fixes the position of the water safety device.

This is where the invention steps in.

It is the object of the invention to optimise the known WC attachment, particularly as regards its construction.

BRIEF SUMMARY

In order to solve this object, the WC attachment referred to above has, in accordance with the invention, a channel through which the leakage from the water safety device is discharged.

The invention is based on the recognition that the arrangement of the water safety device relative to the shower device has a substantial influence on its functionality. Tests have shown that as short as possible a conduit pathway, preferably without any bends, results in a significantly smaller leakage and at the same time in a higher flow volume.

In the known WC attachment, the position of the water safety device with the respect to the shower device is predetermined. The channel in accordance with the invention, on the other hand, permits a significantly more flexible arrangement of the water safety device, which, in particular, is such that the water safety device is arranged not far from the shower device. The leakage is discharged through the channel.

In an advantageous embodiment of the invention, the water connection for the shower device is located in the rear half of the shower device. It is consequently considered to be of advantage also to arrange the water safety device freely, preferably in the rear region of the WC attachment. The channel in accordance with the invention permits an optimal position of the water safety device. The channel ensures reliable discharge of leakage, sprayed water and the like into the WC bowl.

As also in the prior art, the water safety device is connected to the shower device by means of a hose-like conduit. It has transpired that a maximum hose length of 10 cm ensures operation with minimal leakage.

The WC attachment preferably includes a base plate. Such a construction offers the advantage that all the components can be arranged on the base plate. On the one hand, this facilitates maintenance. On the other hand, a (advantageously one-piece) base plate also affords a stable base for the entire structure of the WC attachment.

The base plate preferably consists of plastic material and can be manufactured, for instance, as an injection moulded component. It is considered to be particularly advantageous if the channel is formed integrally with the base plate.

In an important embodiment of the invention, it is proposed that the base plate includes an outlet, preferably formed as an opening, into which the channel discharges. The leakage advantageously flows through the outlet into the. WC bowl, that is to say downwardly through the base plate. In addition to the considerable advantage of direct discharge, the outlet also has the advantage that it is not visible to the user.

The base plate will be fastened to the WC bowl. Its positioning should conveniently be such that the leakage can flow into the WC bowl. An advantageous embodiment of the invention is characterised in that the outlet is arranged in the front region of the base plate. Such a construction permits only a small proportion of the base plate to extend over the opening of the WC bowl, which, in addition to the advantage of better accessibility of the WC bowl opening for cleaning purposes, means also the advantage of a stable and at the same time compact overall construction.

The channel preferably has side walls. The side walls can, for instance, be formed integrally with the base plate and extend upwardly from the base plate. The channel is advantageously at least partially open upwardly. This facilitates, amongst other things, good accessibility in the event of inspection and/or cleaning of the WC attachment.

It was already mentioned above that it can be of advantage to arrange the water safety device in the rear region of the WC attachment or its base plate. In this respect, it is considered to be advantageous if the passage extends forwardly from the rear. It preferably discharges, seen in the lateral dimensional direction of the WC attachment, in the central third of the WC attachment. In an advantageous construction, the nozzle is arranged substantially centrally. The channel discharges adjacent to it.

In order to ensure that the leakage (or sprayed water or the like) is discharged, an advantageous embodiment of the invention is characterised in that the channel slopes downwardly in the forward direction. It is thus advantageously ensured that the water flows forwardly and that water does not back up, which could, amongst other things, also have hygiene disadvantages.

The WC attachment can be so constructed that it includes a fastening device, by means of which it may be fixed to the WC bowl. The fastening device can be so constructed that the WC attachment is fastened directly to the ceramic material of the WC. Alternatively and preferably, a base plate is mounted on the WC bowl and the WC attachment is mounted on the base plate by the fastening device. It is advantageously provided that the channel extends over the fastening device. The water can thus be discharged without the discharge being impeded by the fastening device.

It should be ensured in practice that all the water loss is collected by the channel. For this purpose, it is proposed that the water safety device is arranged above the channel, advantageously such that leakage from the water safety device preferably drips directly downwards into the channel. It can, in particular, be provided that the water safety device extends partially into the channel.

As already stated above, the channel in accordance with the invention offers the possibility of (substantially) freely positioning the water safety device with respect to the shower device. This free positioning can be used to optimise the efficiency of the overall arrangement (low leakage, increased flow volume) and to safeguard materials, which are potentially not permissible in the region of drinking water, at the water inlet to the WC attachment. A further substantial advantage of the channel resides furthermore in that the water safety device can be so positioned that the housing of the water safety device and/or the cover of the WC attachment need not be opened for maintenance purposes, as in the prior art. It is instead possible in one embodiment of the invention to effect maintenance from the exterior. For this purpose, the WC attachment preferably includes a cover, in which a maintenance opening is formed, whereby the water safety device is advantageously arranged adjacent to the maintenance opening. The maintenance opening can be closed with a small cover plate, a stopper or the like.

A WC attachment is considered to be structurally advantageous in which the shower device, the water safety device, the channel and preferably also a valve, which is connected by a conduit to the water safety device, are arranged on the base plate of the shower device. All important components are thus connected to the base plate, which, in particular, results in simple manipulability of the attachment (for instance during assembly).

The invention will be explained in more detail below by way of a preferred exemplary embodiment in conjunction with the attached drawings, in which:

DETAILED DESCRIPTION

Figure 1:
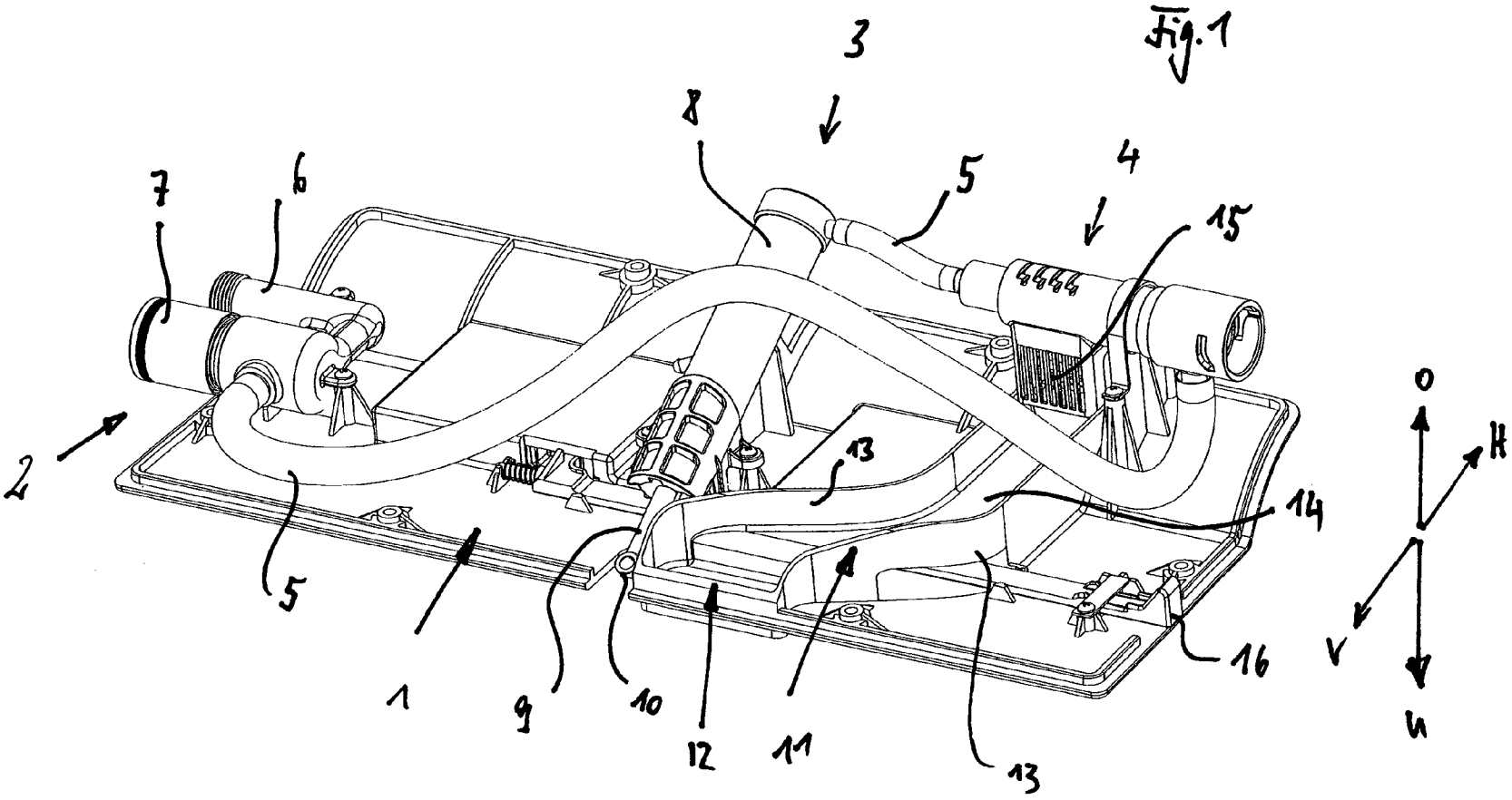
FIG. 1 is a perspective view of a WC attachment in accordance with the invention in the open state.

FIG. 1 shows an exemplary embodiment of a WC attachment in accordance with the invention. The WC attachment includes a base plate 1, on which a valve 2, a shower device 3 and a water safety device 4 are arranged. The valve 2, the shower device 3 and the water safety device 4 are connected together by means of a conduit 5, which advantageously comprises a plurality of conduit sections.

The valve 2 includes a water connector 6 and an actuating knob 7. The WC attachment is connected via the water connector 6 to a water conduit (not shown) for the supply of water. The water volume, which is to flow out of the shower device, is controlled by means of the actuating knob 7.

The shower device 3 includes a stationary housing section 8 and a nozzle section 9, which is extendible under water pressure 9 and situated at whose end there is a nozzle 10. The water discharges from the nozzle 10 for cleaning purposes.

Arranged between the valve 2 and the shower device 3 is the water safety device 4. The water safety device 4 includes an injector (not visible), from which a water jet is sprayed over a free section. Such a water safety device is preferably arranged horizontally. This means that the water jet goes horizontally over the free section. If water flows back, contamination of the mains water is excluded by the free space.

In operation, leakage can occur at the water safety device 4. This leakage (or sprayed water or the like) is discharged through a channel 11 into the WC bowl.

For this purpose, the base plate 1 includes an opening 12 into which the channel 11 discharges. The leakage flows into the WC bowl through the opening 12. The opening is arranged in the central third of the breadth of the base plate. The opening of the WC bowl has its maximum extent at this position.

The channel 11 includes side walls 13 and is preferably constructed integrally with the base plate 1. The channel base 14 has a gradient towards the opening 12. Any water is thus reliably discharged without the risk of standing water.

The water safety device 4 includes a spacer, which can preferably be constructed in the form of a grid 15, which discharges the sprayed water directly into the channel 11. The spacer has a height (maximum dimension) of at least 2 cm. This ensures particularly advantageously the maintenance of requirements specific to drinking water. The water safety device extends (in the present case with the grid 15) into the channel 11 and thus provides reliable interception of all sprayed water.

The WC attachment is fastenable to the WC bowl by means of a fastening device. For this purpose, the WC attachment includes an actuating device 16, which is movable into engagement with a mounting plate 17 (see FIG. 3) preassembled on the WC bowl. The channel 11 extends over the actuating device 16.

Incidentally, it is made clear again with reference to the coordinate system what is to be understood by the positional information top (O), bottom (U), front (V) and rear (or back) (H). These are consistent with the usual terminology relating to a WC. This applies also to the references to the shower device. It is also apparent from FIG. 1 that the water safety device 4 is arranged in the rear region of the base plate 1 and that the channel 11 extends forwardly from the rear.

Figure 2:
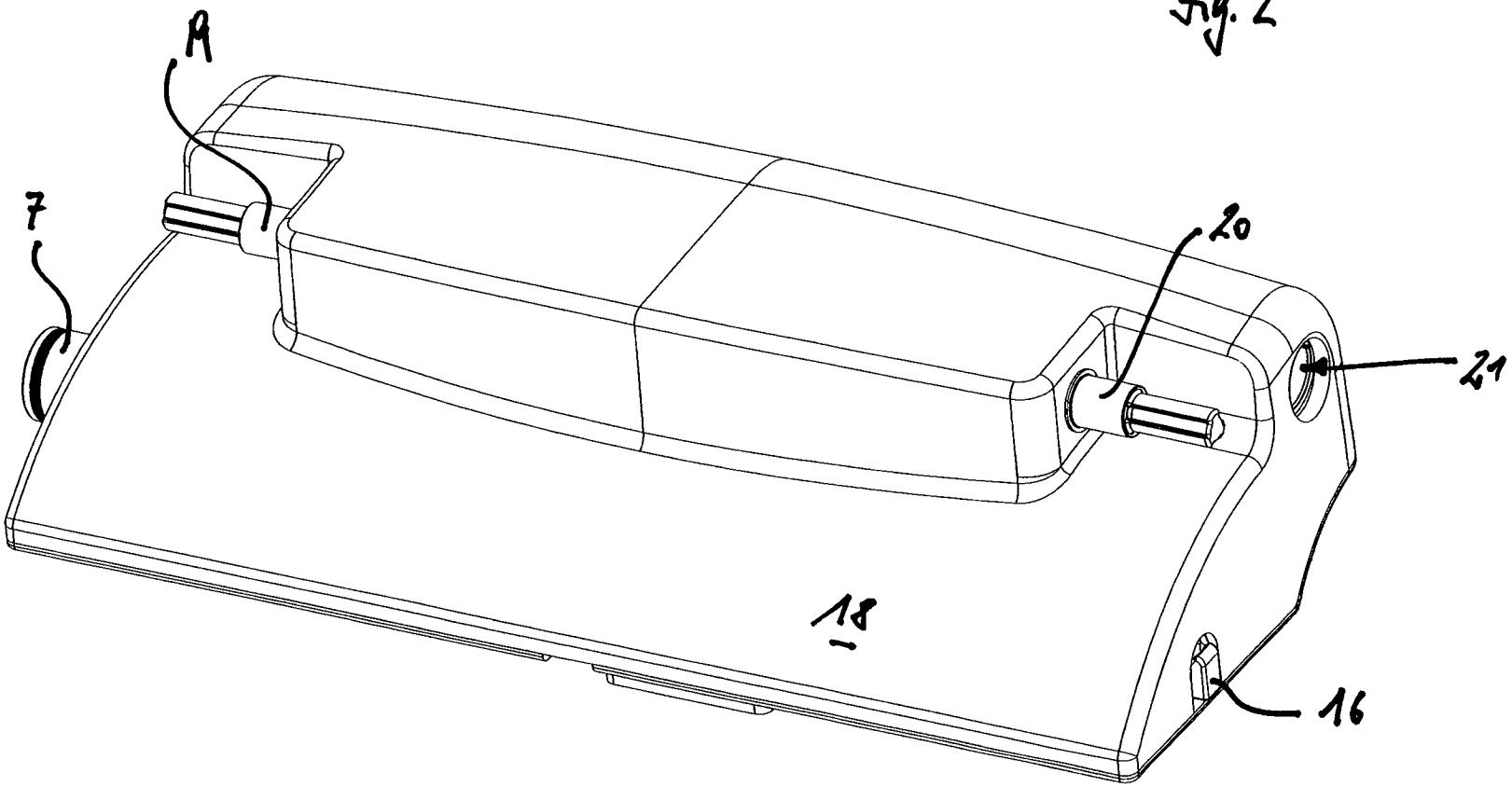
FIG. 2 is a perspective view of the WC attachment of FIG. 1 with a cover.

FIG. 2 shows the WC attachment of FIG. 1 with a housing cover 18. The WC attachment also includes two pivot pegs 19, 20, on which a WC seat is pivotally mounted. The pivot pegs are held stationary. Formed in the housing 1 is a lateral opening 21. This opening 21 is preferably aligned with the water safety device 4. As a result of this feature, the water safety device 4 is accessible through the opening 21, for instance for maintenance purposes, without the cover 18 having to be removed.

Figure 3:
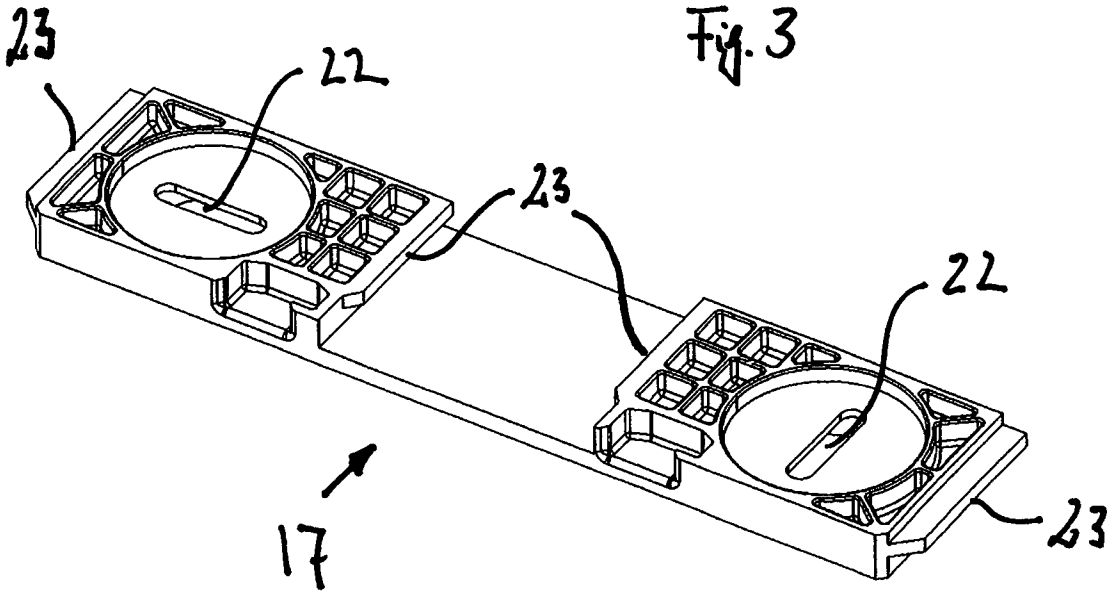
FIG. 3 is a schematic view of a mounting plate for fastening the WC attachment to a WC bowl.

FIG. 3 shows a mounting plate 17, which can be preinstalled on a WC bowl. The mounting plate 17 has two elongate holes 22, through which screws or threaded pegs (not shown) pass, with which the mounting plate is fastened to the WC bowl. The WC attachment is pushed onto the mounting plate 17. In order to anchor the base plate 1, the mounting plate 17 includes rail-like webs 23, which engage in corresponding recesses in the base plate.

LIST OF REFERENCE NUMERALS

1 Base plate
2 Valve
3 Shower device
4 Water safety device
5 Conduit
6 Water connection
7 Actuating knob
8 Housing section
9 Nozzle section
10 Nozzle
11 Channel
12 Opening
13 Side walls
14 Channel base
15 Grid
16 Actuating device
17 Mounting plate
18 Housing cover
19 Pivot peg
20 Pivot peg
21 Opening
22 Elongate hole

The invention claimed is:

1. A water closet (WC) attachment including:
a shower device;
a valve,
a water safety device, wherein the valve, the shower device and the water safety device are connected by a conduit, and wherein the water safety device is arranged between the valve and the shower device;
a channel for discharging leakage from the water safety device;
wherein the WC attachment includes a base plate, on which the shower device, the valve, the water safety device and the channel are arranged; and
wherein the channel slopes downwardly in the forward direction.

2. A WC attachment as claimed in claim 1, characterised in that the channel is formed integrally with the base plate.

3. A WC attachment as claimed in claim 1, characterised in that the base plate includes an outlet, with which the channel communicates.

4. A WC attachment as claimed in claim 3, characterised in that the outlet is arranged in a front region of the base plate.

5. A WC attachment as claimed in claim 1, characterised in that the channel includes side walls.

6. A WC attachment as claimed in claim 1, characterised in that the channel extends forwardly from a rear region of the base plate, whereby it preferably discharges in a central third of the WC attachment, seen in the lateral dimensional direction of the WC attachment.

7. A WC attachment as claimed in claim 1, characterised in that the water safety device extends partially into the channel.

8. A WC attachment as claimed in claim 1, characterised in that the WC attachment includes a cover, in which a maintenance opening is formed, wherein the water safety device is preferably arranged adjacent to the maintenance opening.

9. A water closet (WC) attachment comprising:
a base plate;
a valve supported on the base plate;
a shower device supported on the base plate;
a water safety device supported on the base plate;
a first conduit fluidly connecting the valve to the water safety device;
a second conduit fluidly connecting the water safety device to the shower device; and
a channel disposed on the base plate separate from the water safety device and communicating therewith, the channel being adapted to discharge leakage from the water safety device.

10. The WC attachment of claim 9, wherein the channel is of one piece with the base plate and comprises a pair of spaced side walls protruding generally vertically from a plane of the base plate.

11. The WC attachment of claim 9 further comprising an outlet defined in the base plate, wherein an outlet end of the channel is located adjacent the outlet.

12. The WC attachment of claim 11, wherein the channel slopes downwardly from a rear portion of the base plate towards a front portion thereof, and wherein the outlet is located in the front portion of the base plate.

13. The WC attachment of claim 9, further comprising a spacer supporting the water safety device and wherein an inlet end of the channel is located adjacent the spacer.

14. The WC attachment of claim 9, further comprising a cover adapted to cooperate with the base plate so as to enclose the shower device, the water safety device and the channel.

15. The WC attachment of claim 14, wherein the cover includes a maintenance opening affording access to the water safety device.

16. The WC attachment of claim 9, further comprising a fastening device mounted to the base plate, the fastening device being adapted to fasten the WC attachment to an associated WC bowl.

17. A water closet (WC) attachment including:
a shower device;
a valve,
a water safety device, wherein the valve, the shower device and the water safety device are connected by a conduit, and wherein the water safety device is arranged between the valve and the shower device;
a channel for discharging leakage from the water safety device;
wherein the WC attachment includes a base plate, on which the shower device, the valve, the water safety device and the channel are arranged; and
a fastening device for fastening the WC attachment to an associated WC bowl and wherein the channel extends over the fastening device.

18. A WC attachment as claimed in claim 17, wherein the channel slopes downwardly in the forward direction.

* * * * *